US007137518B2

(12) United States Patent
Irsch et al.

(10) Patent No.: US 7,137,518 B2
(45) **Date of Patent: *Nov. 21, 2006**

(54) TELESCOPIC CRANE

(75) Inventors: Michael Irsch, Lebach (DE); Conrad Frank, Hornbach (DE); Jens Fery, Ensdorf (DE); Walter Zimmer, Inbert (DE); Walter Stowasser, Zweibrücken (DE); Oliver Fries, Schiffweiler (DE); Roland Kuhn, Ingbert (DE); Markus Marx, Schwalbach (DE)

(73) Assignee: Terex-Demag GmbH & Co. KG, Zweibrucken (DE)

( * ) Notice: Subject to any disclaimer, the term of this patent is extended or adjusted under 35 U.S.C. 154(b) by 486 days.

This patent is subject to a terminal disclaimer.

(21) Appl. No.: 10/400,193

(22) Filed: Mar. 26, 2003

(65) Prior Publication Data

US 2004/0040926 A1 Mar. 4, 2004

Related U.S. Application Data

(63) Continuation-in-part of application No. 09/605,403, filed on Jun. 28, 2000, now Pat. No. 6,550,624.

(30) Foreign Application Priority Data

Jun. 28, 1999 (DE) ..... 199 305 374

(51) Int. Cl.
*B66C 23/04* (2006.01)

(52) U.S. Cl. ..... 212/299; 52/118; 212/231; 212/348

(58) Field of Classification Search ..... 212/298, 212/348, 299, 231; 52/118, 148, 149, 150, 52/151

See application file for complete search history.

(56) References Cited

U.S. PATENT DOCUMENTS 220,031 A 9/1879 Meyer et al.
3,593,534 A 7/1971 Seidel (Continued)

FOREIGN PATENT DOCUMENTS

DE 1 751 383 8/1957

(Continued)

OTHER PUBLICATIONS

Mannesmann Demag Fördertechnik: "Demag AC 1600", Apr. 1996.

(Continued)

*Primary Examiner*—Thomas J Brahan
(74) *Attorney, Agent, or Firm*—Fay Kaplun & Marcin, LLP

(57) ABSTRACT

A telescopic crane, includes a substructure, a superstructure rotatably mounted onto the substructure, a counterweight and a telescoping boom structure which includes a main boom slewable about a luffing plane. The main boom has a boom base and at least one telescope section received in the boom base and displaceable between retracted and extended positions. At least one guy support is mounted to the boom structure and connected to a guy rope which extends substantially longitudinally in the direction of the boom structure. The guy support is oriented with respect to the luffing plane at an inclination which is so selected that a lateral load acting on the boom structure is partially or entirely received by the guying.

49 Claims, 10 Drawing Sheets

U.S. PATENT DOCUMENTS

| | | | | |
|---|---|---|---|---|
| 3,638,806 | A | 2/1972 | Hippach | |
| 3,918,592 | A | 11/1975 | Paul | |
| 4,106,631 | A | 8/1978 | Lundy | |
| 4,360,111 | A | 11/1982 | Weiskopf | |
| 4,512,482 | A | 4/1985 | Mentzer | |
| 4,967,917 | A | 11/1990 | Koizumi et al. | |
| 4,976,361 | A | 12/1990 | Becker | |
| 5,281,078 | A | 1/1994 | Mills, Jr. | |
| 5,597,081 | A | 1/1997 | Shirley | |
| 5,803,279 | A | 9/1998 | Stallbaumer et al. | |
| 6,062,793 | A | 5/2000 | Isley | |
| 6,550,624 | B1 * | 4/2003 | Irsh et al. | 212/299 |

FOREIGN PATENT DOCUMENTS

| | | | |
|---|---|---|---|
| DE | 1 531 155 | | 12/1969 |
| DE | 29 17 829 | A1 | 11/1980 |
| DE | 30 30 820 | A1 | 3/1981 |
| DE | 31 05 771 | A1 | 9/1982 |
| DE | 3113763 | A1 | 10/1982 |
| DE | 3113763 | C2 | 10/1982 |
| DE | 31 39 853 | A1 | 4/1983 |
| DE | 37 34 919 | A1 | 4/1989 |
| DE | 38 40 408 | A1 | 10/1989 |
| DE | 02209395 | | 8/1990 |
| DE | 38 38 975 | C2 | 2/1991 |
| DE | 93 11 778 | | 1/1995 |
| DE | 196 06 109 | A1 | 6/1997 |
| DE | 297 20 972 | U1 | 5/1999 |
| DE | 198 02 187 | A1 | 7/1999 |
| GB | 2 096 097 | | 10/1982 |
| RU | 1606439 | | 11/1990 |

OTHER PUBLICATIONS

Biggest Derrick Crane in the Federal Republic of Germany helps constructing a nuclear reactor, in: Deutsche Herbe- und Fördertechnik, 1972.

R. Cajar: "Baukrane", Munich and Berlin, 1930.

* cited by examiner

TELESCOPIC CRANE

CROSS-REFERENCES TO RELATED APPLICATIONS

This is a continuation-in-part of prior filed copending U.S. patent application No. 09/605,403, filed Jun. 28, 2000 now U.S. Pat. No. 6,550,624, which claims the priority of German Patent Application, Serial No. 199 305 37.4, filed Jun. 28, 1999.

BACKGROUND OF THE INVENTION

The present invention relates to a telescopic crane of a type having a substructure, a revolving superstructure mounted to the substructure, a counterweight and a boom structure comprised of a main boom having a boom base and at least one telescope section which is received in the boom base and displaceable between retracted and extended positions.

In extended position, telescopic cranes are exposed to varying degrees of stress depending on the angular disposition. Oftentimes, the lateral deformation of the main boom in steep-incline disposition is the criterion that limits the load-carrying capability. When the angular disposition is flat or average, the loads applied in the mounting of the extended telescope sections represent a crucial criterion for the maximum load-carrying capability. In the latter case, the so-called super lift operation has been developed for torque relief.

The use of telescopic cranes with super lift operation has been known for a long time. An example is illustrated in a brochure issued by Mannesmann Demag Fördertechnik, Demag AX 1600, April 1996, pages 5, 17 and 27. A guy truss is arranged on the boom base of the main boom for placement on the boom base to increase the load-carrying capability and to reduce sag of the main boom. The guy truss is connected, on the one hand, to the foot region of the main boom via a guy rope of substantially constant length, and, on the other hand, to the head or collar of one of the inner telescope sections via a further guy rope of normally variable length. This reinforcing configuration is applicable for the base unit alone, or in conjunction with the arrangement of a fly jib in the form of a latticed tower which can be of the fixed type or luffing type. Telescopic cranes of this kind suffer shortcomings because the boom structure deforms laterally, especially in steep-incline disposition.

SUMMARY OF THE INVENTION

It is thus an object of the present invention to provide an improved telescopic crane, obviating the afore-stated drawbacks.

In particular, it is an object of the present invention to provide an improved telescopic crane whose lateral deformation of the boom structure is significantly reduced, in particular in steep-incline disposition, compared to conventional telescopic cranes.

These objects, and others which will become apparent hereinafter, are attained in accordance with the present invention by providing at least one guy support which is mounted to the boom structure and connected to a tension means extending substantially longitudinally in the direction of the boom structure, with the guy support oriented with respect to the luffing plane at an inclination which is so selected that a lateral load acting on the boom structure is partially or entirely received by the guying.

The inclination of the guy support can be realized transversely to the longitudinal direction or in longitudinal direction or in superimposed transversely to and longitudinally in direction of the boom structure.

According to another feature of the present invention two inclined guy supports can be provided on the topside of the respective boom element of the boom structure, whereby the angular disposition of both guy supports is normally identical. Of course, the angular disposition of both guy supports may also differ depending on the direction of the forces acting on the boom structure. The foot ends of both guy supports may be connected to the topside of the boom structure at a common area, or may be offset to one another. It is also conceivable to connect the foot end of the guy supports with the boom structure in the transition zone (i.e., the transition area) between topside and respective sidewall. As an alternative, there is also the option to arrange the foot end of at least one of the guy supports upon a girder which extends transversely to the longitudinal axis of the boom structure and projects beyond the boom structure.

Through the provision of a guy support according to the present invention, the portion of the guying force, effective in lateral direction, can be gradually and continuously modified in dependence on the angular disposition of the guy support. In the event, two guy supports are arranged offset to one another, both parallel guy supports act as super lift operation in a same manner as the conventional guy truss, when the boom structure is in the one extreme disposition, i.e. vertical disposition. At an angular position of <90° to>0° for both guy supports, the effective tautening force is split into a component super lift operation and a component lateral guying. In the other extreme position, i.e. horizontal disposition, both guy supports realize a reinforcement in both lateral directions.

The free head end of each guy support can be selectively connected via a first tension member (i.e., a first tension sub-arrangement) with the substructure, the superstructure, the foot region of the boom structure, the fixed or separately guided counterweight, or the bottom in the direction of the boom structure, and via a further tension member (i.e., a second tension sub-arrangement) with a selected area of the boom structure in the direction of its head. The respectively desired angular disposition of the guy supports may be adjusted step-by-step or continuously by swinging the guy supports, so that an asymmetric angular disposition is also possible. Thus, when a lateral force is applied on one side, the respective guy support is inclined progressively in the direction of lateral guying whereas the other guy support remains in a central position.

As the distance of the tension members from the boom structure has also an impact on the desired reinforcement, it is proposed to change the length of the guy supports in steps or continuously. The tension members may be a guy rope or a guy rod, and may be arranged with or without prestress. When prestressed at a degree that can be re-adjusted, the tension means is operatively connected with a tensioning mechanism. Suitably, the tensioning mechanism is a winch or a piston and cylinder unit. However, it is also possible, to exploit the angular disposition and/or change in length of the guy supports as tensioning mechanism. The tensioning mechanism may be selectively mounted to the guy supports, to the boom structure, to the superstructure or substructure, or to the counterweight.

According to another feature of the present invention, the guy supports are mounted to the main boom in the area of the boom base, in particular in the forward region between the hinged attachment of the luffing cylinder and the forward bearing on the boom base. Each guy support is suitably connected to a piston and cylinder unit which is mounted to the boom base, for continuous adjustment of the guy supports.

According to another feature of the present invention, the guy support includes two poles between which the winch may be positioned.

A telescopic crane according to the present invention may be further complemented by a fixed or luffing fly jib in the form of a latticed mast. Guy supports in accordance of the present invention may also be mounted to this type of jib.

A lateral guying is especially effective when the crane is provided with a measuring device, e.g. a load cell, for detecting a lateral deformation of the boom structure. When the deformation exceeds a predetermined admissible value, the tension member connected to the guying is activated for tautening the guying. The extent of lateral deformation can be registered directly or indirectly via crane parameters, for example, the rope tension, the rope length and the rope extension. However, forces acting upon the boom structure may be used for determination the degree of lateral deformation, such as side winds, exposure to sunlight and temperature of the boom structure.

BRIEF DESCRIPTION OF THE DRAWING

The above and other objects, features and advantages of the present invention will be more readily apparent upon reading the following description of preferred exemplified embodiments of the invention with reference to the accompanying drawing, in which.

DETAILED DESCRIPTION OF PREFERRED EMBODIMENTS

Figure 1A:
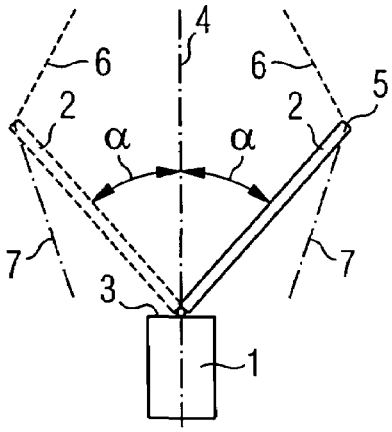
FIG. 1*a* is a principal illustration of a first embodiment of a telescopic crane according to the present invention, illustrating the arrangement of a guy support which is inclined with respect to the luffing plane.

Throughout all the Figures, same or corresponding elements are generally indicated by same reference numerals.

Turning now to the drawing, and in particular to FIG. 1, there is shown a principal illustration of a first embodiment of a telescopic crane according to the present invention, illustrating the arrangement of a guy support 2 which is inclined with respect to the luffing plane. The guy support 2 is mounted, preferably, onto the topside of an exemplified boom element 1 of a boom structure (not shown). The boom element 1 is shown here only symbolically by way of a box for sake of simplicity and may represent a boom base or a telescope section of a main boom of the telescopic crane or the latticed tower of a fixed or luffing fly jib. The boom element 1 is defined by a center axis 4 which, ideally, is also the luffing plane of the boom structure.

In accordance with the present invention, the guy support 2 is inclined with respect to the luffing plane at an angle of $\alpha>0$. As shown by broken lines, the guy support 2 may also be inclined to the other side. The guy support 2 has a free end 5 which is guyed by means of tension members 6, 7, preferably guy ropes. Although not shown in detail, the tension members 6, 7 are connected at a fixed point on the boom structure, or a tensioning mechanism such as a piston and cylinder unit, or a winch. Tautening of the tension members 6, 7 may, however, also be realized without use of a tensioning mechanism by arranging the tension members 6, 7 at a smaller or greater angel $\alpha$ and then further inclining the guy support 2. As an alternative, it is also possible to make the guy support 2 of telescopic configuration to effectuate a tautening through change in length.

Figure 1B:
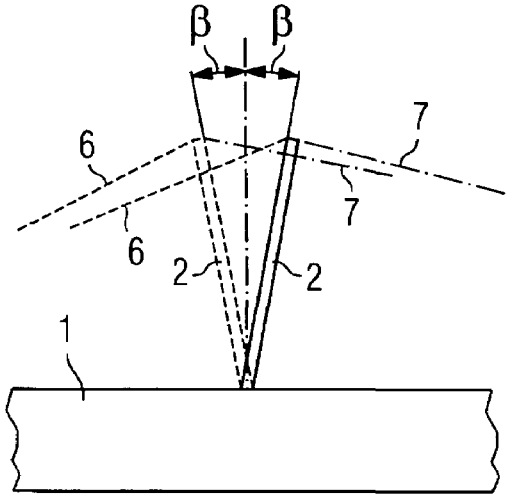
FIG. 1*b* is a 90° rotated disposition thereof.
Figure 1C:
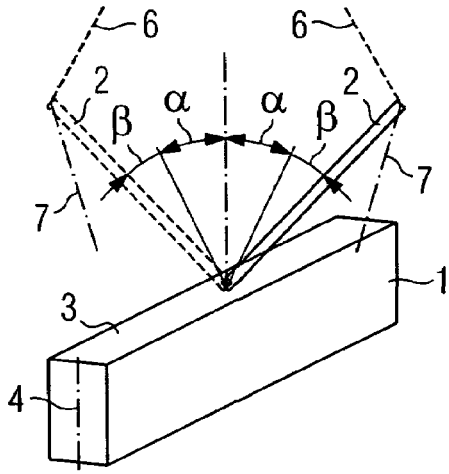
FIG. 1*c* is a perspective illustration thereof.

As shown in FIG. 1*b*, which is an illustration in 90° rotated disposition, the guy support 2 may also be inclined in another plane at an angle $\beta>0$. FIG. 1*c* shows the option to superimpose the inclination of the guy support 2 in both planes.

Figure 2:
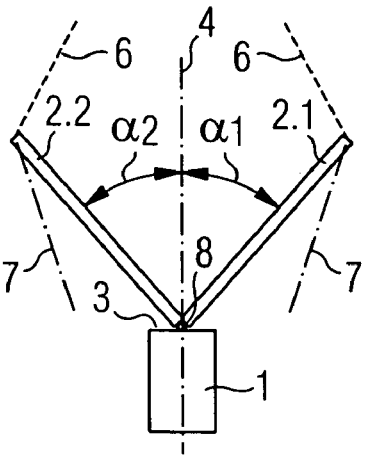
FIG. 2 is a principal illustration of a second embodiment of a telescopic crane according to the present invention, illustrating the arrangement of two inclined guy supports converging at a common foot end.

Turning now to FIG. 2, there is shown a principal illustration of a second embodiment of a telescopic crane according to the present invention, illustrating the arrangement of two inclined guy supports 2.1, 2.2 which converge to a single common foot end 8 swivel-hinged at the topside 3 of the boom element 1. The angle of inclination $\alpha 1$ of the guy support 2.1 with respect to the luffing plane 4 and the angle of inclination $\alpha 2$ of the guy support 2.2 with respect to the luffing plane 4 may be identical or different.

Figure 3A:
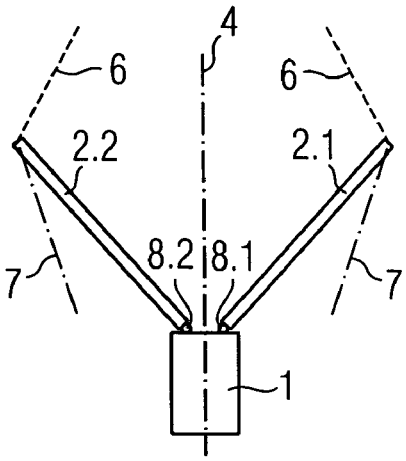
FIGS. 3*a* to 3*d* are principal illustrations of a third embodiment of a telescopic crane according to the present invention, illustrating variations of an arrangement of two inclined guy supports terminating in separate foot ends.
Figure 3B:
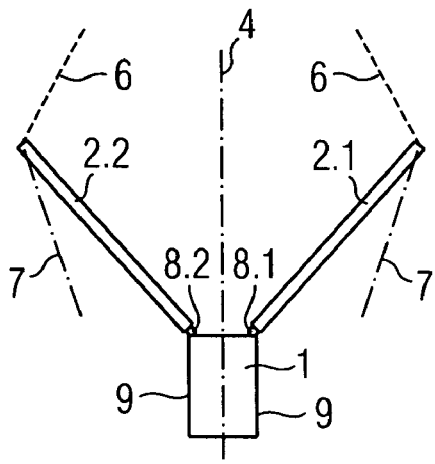
Figure 3C:
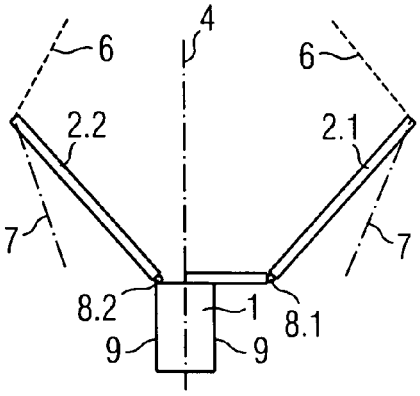
Figure 3D:
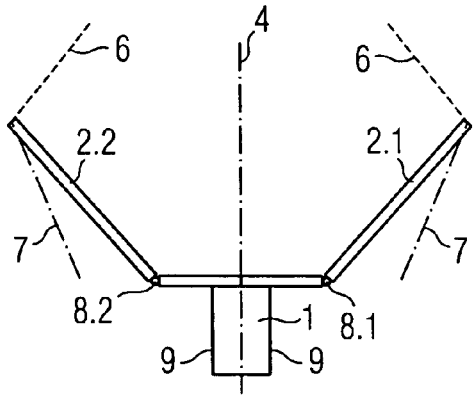

FIGS. 3*a* to 3*d* show principal illustrations of a third embodiment of a telescopic crane according to the present invention, illustrating variations of an arrangement of two inclined guy supports 2.1, 2.2 terminating in separate foot ends 8.1, 8.2, respectively. In FIG. 3*a*, the foot ends 8.1, 8.2 terminate on the topside 3 of the boom element 1 whereas in FIG. 3*b* the foot ends 8.1, 8.2 terminate in the transition zone from the topside 3 to the respective sidewall 9. FIG. 3*c* depicts the option to arrange at least one of the foot ends, here foot end 8.1, outside of the boom element 1. In this case, a girder 10 is secured onto the topside 3 and projects out to the right of FIG. 3*c*, with the foot end 8.1 of the guy support 2.1 swivel-hinged to the end of the girder 10. FIG. 3*d* shows the option to place onto the topside 3 of the boom element 1 a girder 11 which projects out from both sides of the boom element 1 so that both foot ends 8.1, 8.2 of both guy supports 2.1, 2.2 are positioned outside the boom element 1.

Figure 4:
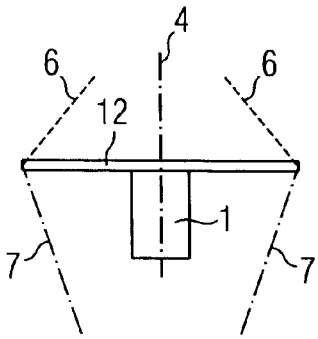
FIG. 4 is a principal illustration of a fourth embodiment of a telescopic crane according to the present invention, illustrating the arrangement of a guy support in traverse disposition.

A special case is illustrated in FIG. 4 which depicts the provision of a guy support in the form of a girder 12 extending across the topside 3 of the boom element 1 beyond the boom element 1. This special case can be realized by positioning the guy supports 2.1, 2.2 of FIG. 2 at angles of inclinations $\alpha 1$ and $\alpha 2$ of 90°.

Figure 5B:
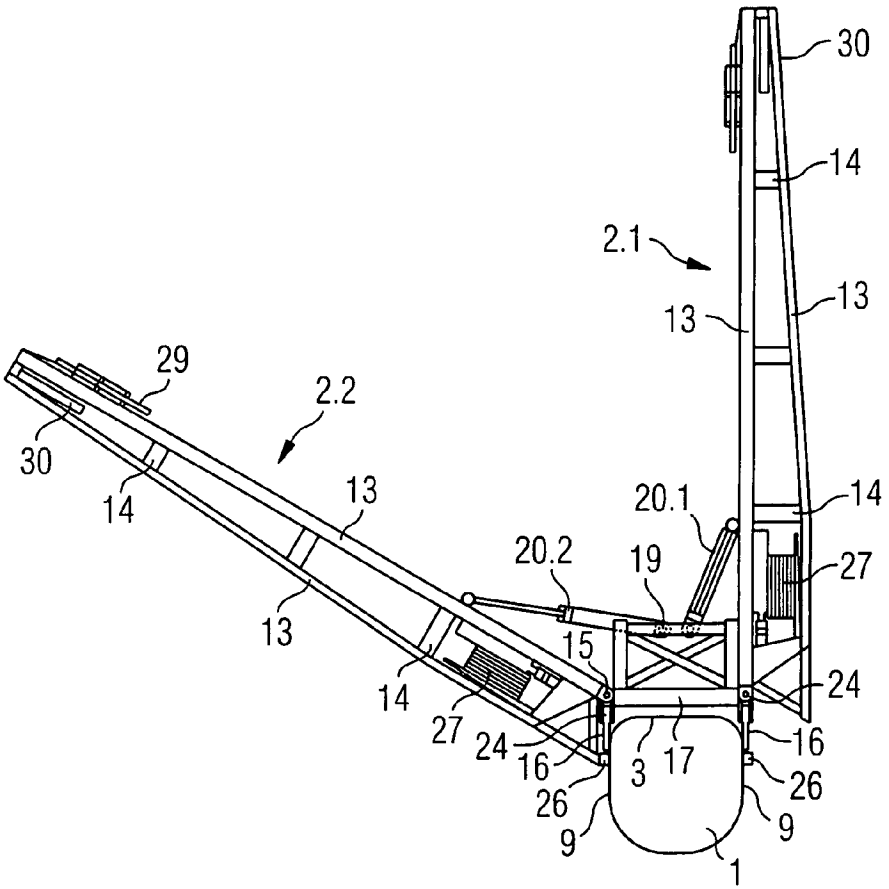
FIG. 5*b* is a side view thereof.
Figure 5A:
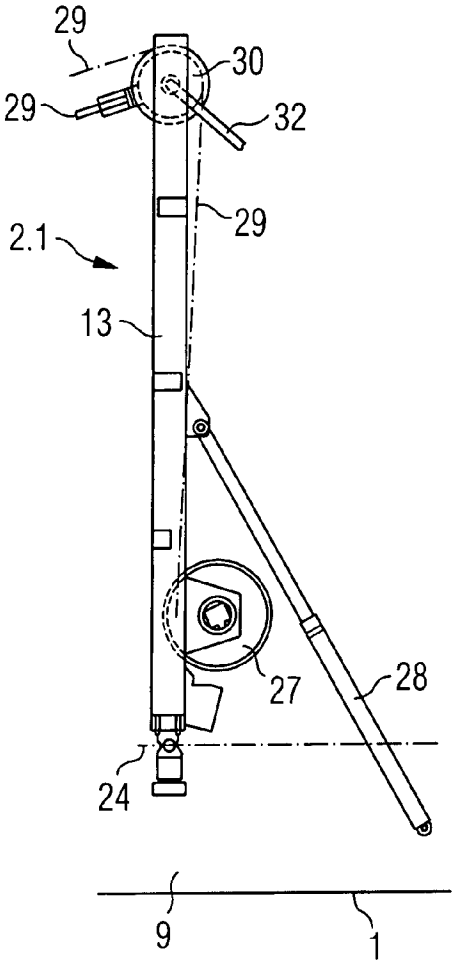
FIG. 5*a* is a front view of an exemplified telescopic crane embodying the principals of the present invention with two inclined guy supports.

Referring now to FIGS. 5*a* and 5*b*, there are shown a front view and a side view, respectively, of an exemplified telescopic crane embodying the principles of the present invention with two inclined guy supports 2.1, 2.2. In this non-limiting example, the boom element 1 is represented by a boom base of a main boom of the telescopic crane. Swingably mounted to the topside 3 of the boom base 1 is a superstructure 15 which is connected to the boom base 1 via brackets 16. The superstructure 15 includes an upper girder 19 and a lower girder 17 which has opposite ends for respective attachment of the guy supports 2.1, 2.2 which are tiltable to the side. The guy support 2.1 is tilted continuously by a piston and cylinder unit 20.1 which has one end hinged to the guy support 2.1 and another end hinged to the upper girder 19 of the superstructure 3. Likewise, the guy support 2.2 is tilted continuously by a piston and cylinder unit 20.2 which has one end hinged to the guy support 2.2 and another end hinged to the upper girder 19 of the superstructure 15. The example shown in FIGS. 5*a*, 5*b* illustrates the case in which the right-hand guy support 2.1 is in a vertical disposition, comparably to a guy truss, while the left-hand guy support 2.2 occupies the greatest slewable disposition.

As the guy supports 2.1, 2.2 are of an identical construction, the following description refers only to the guy support 2.1. However, it will be understood by persons skilled in the art that a description of one of the guy supports 2.1, 2.2 is equally applicable to the other one of the guy supports 2.1, 2.2. The guy support 2.1 includes two poles 13 which extend substantially parallel in the lower section and slightly converge in the area of the upper section. Interconnection of both poles 13 is realized by crossbars 14. The inner one of the poles 18 is provided at its foot end with a hinge 24. The outer one of the poles 13 bears upon the upper portion of the sidewall 9 of the boom base 1 when the guy supports 2.1 occupies their greatest inclination. This respective point of attack on the sidewall 9 is suitable reinforced by sheet metal 26. A winch 27 is rigidly positioned between the poles 13 in the lower area of the guy support 2.1. A guy rope 29 is secured on one end via a rope-end fitting or thimble 31 to the top region of the guy support 2.1 and is guided from there in the direction to a point of reversal (not shown), arranged at the boom tip, and back to a deflector sheave 30 disposed in the top area of the guy support 2.1. From there, the guy rope 29 runs to the winch 27. Positioned on the backside in the top area of the guy support 2.1 is a guy rod 32 for providing a rear safety mechanism for the guy support 2.1.

As described above, the superstructure 15 is swingable so that both guy supports 2.1, 2.2 can be deposited parallel to the topside 3 of the base boom 1 for transport of the telescopic crane. To raise again the guy supports 2.1, 2.2, each of the guy supports 2.1, 2.2 is provided as set-up aid with a piston and cylinder unit 28 (only the piston and cylinder unit 28 of guy support 2.1 is shown here) which has one end hinged to the sidewall 25 and another end hinged to a central region of the pertaining guy support.

Figure 6:
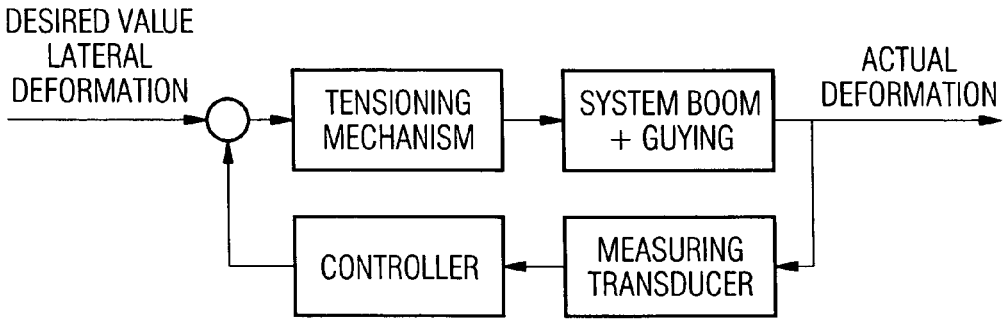
FIG. 6 is a block diagram of a measuring circuit for detecting a lateral deformation of the boom structure of a telescopic crane according to the present invention.

As shown in FIG. 6, the lateral guying is especially effective when providing the crane with a measuring device for detecting a lateral deformation of the boom structure. When the deformation exceeds a predetermined admissible value, the tension member connected to the guying is activated for tautening the guying. The extent of lateral deformation can be registered directly or indirectly by the measuring device via crane parameters, for example, the rope tension, the rope length and the rope extension. However, forces acting upon the boom structure may be used for determination the degree of lateral deformation, such as side winds, exposure to sunlight and temperature of the boom structure.

Figure 7A:
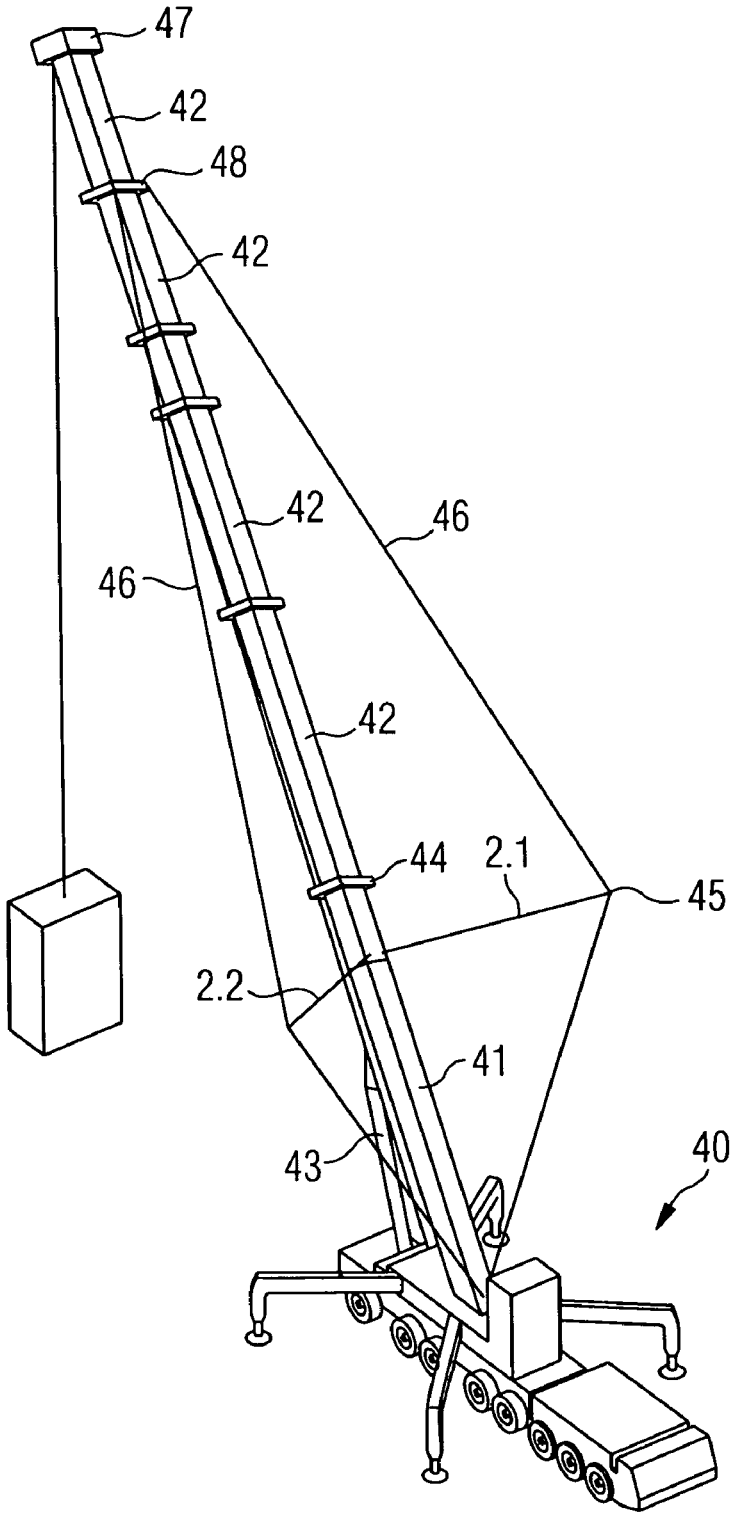
FIGS. 7*a*–7*c* show various exemplified illustrations of telescopic cranes embodying the principles of the present invention.
Figure 7B:
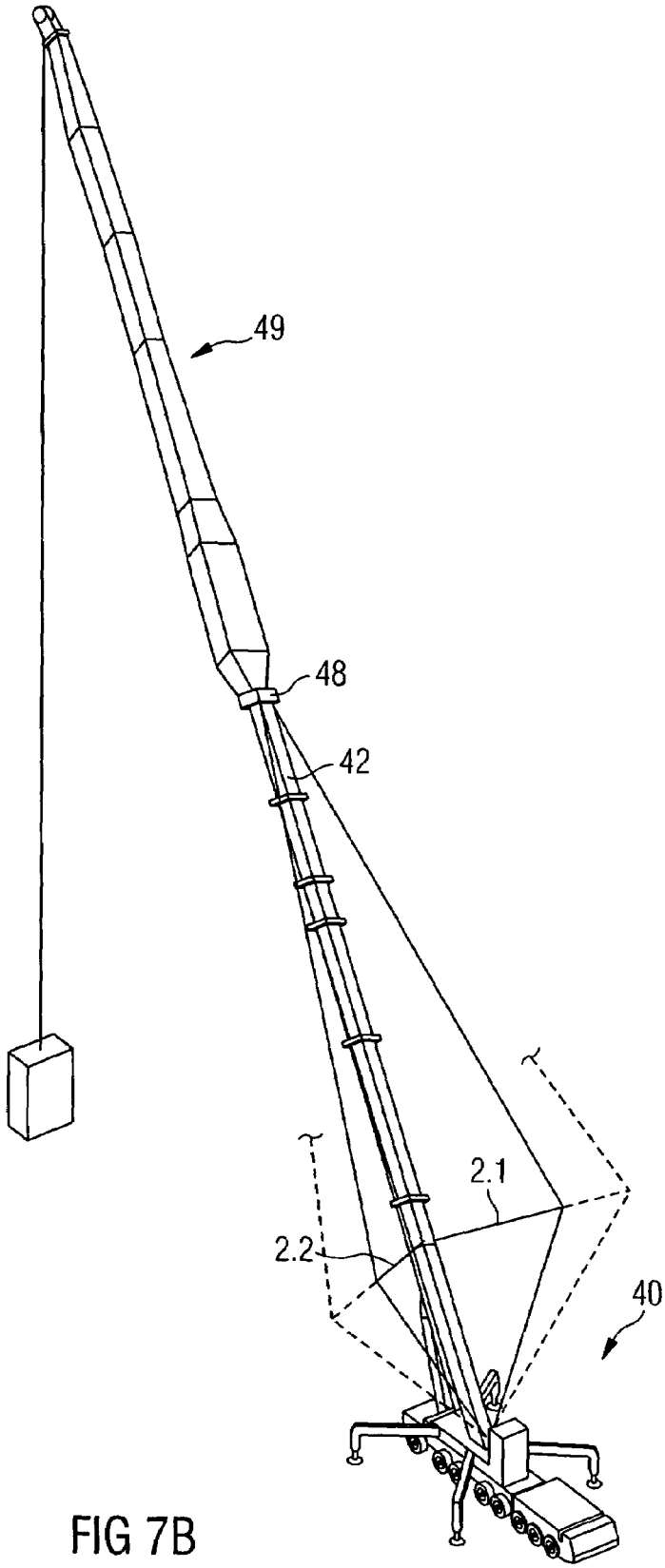
Figure 7C:
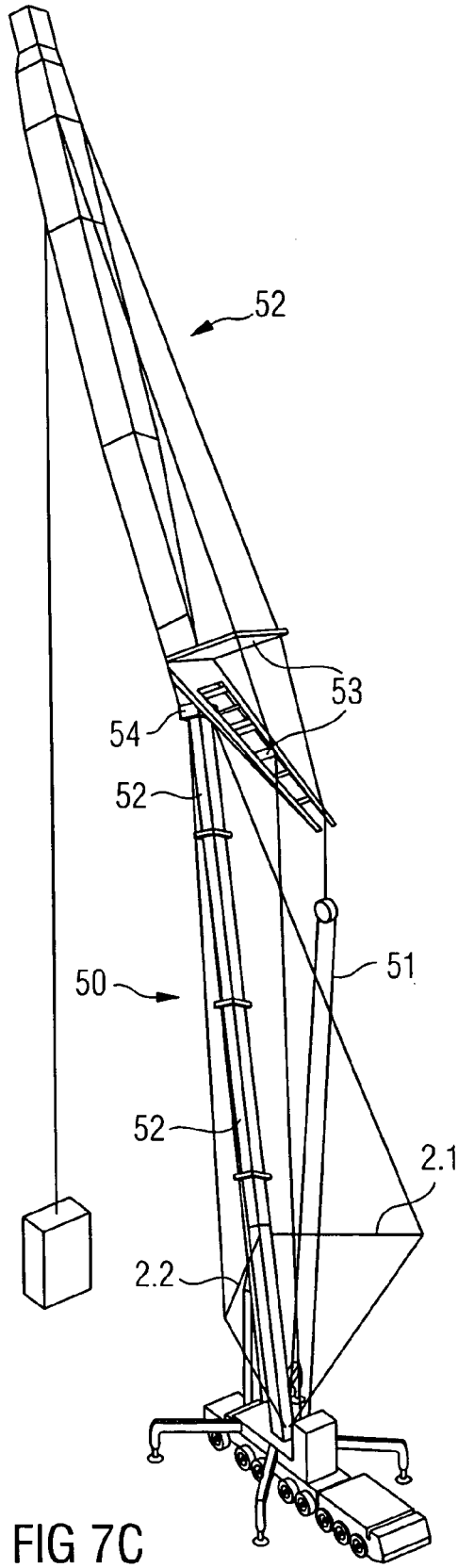

FIGS. 7*a*–7*c* show various exemplified illustrations of telescopic cranes embodying the principles of the present invention. In each of these embodiments, the guy supports 2.1 and 2.2 may be pivotally attached to a boom base and/or to an extension thereof (e.g., a telescopic section 42, a fixed/rigid fly jib, a luffing fly jib, etc.). FIG. 7*a* shows a schematic illustration of a mobile telescopic boom crane, generally designated by reference numeral 40 and including a boom base 41 and a plurality of telescope sections 42, with the laterally inclined guy supports 2.1, 2.2 arranged in a forward region between a luffing cylinder 43 and a forward bearing 44 on the boom base 41. The guy supports 2.1, 2.2 have free ends 45 which are connected by boom guy lines 46 in the direction of the boom structure head 47 with the head section or collar 48 of an inner one of the telescope sections 42.

FIG. 7*b* shows a schematic illustration of the telescopic boom crane 40 provided with a rigid fly jib, generally designated by reference numeral 49 to form a tower-like latticed extension of the boom crane 40. The fly jib 49 is mounted to the head 48 of the innermost one of the telescope sections 42.

FIG. 7*c* shows a schematic illustration of a telescopic boom crane, generally designated by reference numeral 50 and including a plurality of telescope sections 52 and a mast 51. The boom crane 50 is extended by a luffing fly jib, generally designated by reference numeral 52 to form a tower-like latticed extension of the boom crane 50. The luffing jib 52 has at least one, suitably two, slewed supports 53 which are mounted to the head 54 of an innermost one of the telescope sections 52.

Figure 7D:
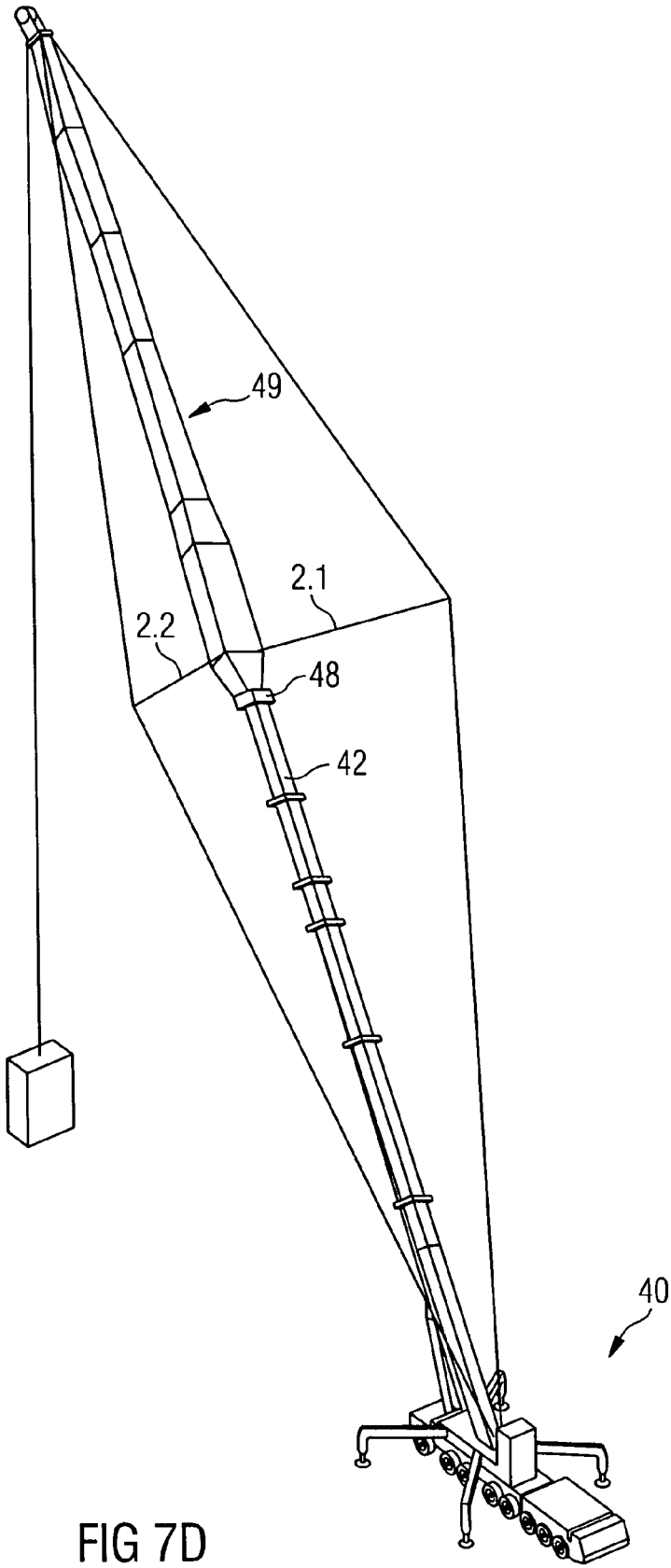

FIG. 7*d* shows an illustration of a telescopic boom crane 40, providing guy supports 2.1 and 2.2 pivoting on an extension. As shown, the guy supports 2.1 and 2.2 are pivoting on the fly jib 49, which is mounted to the innermost one of the telescopic sections 42.

Figure 8:
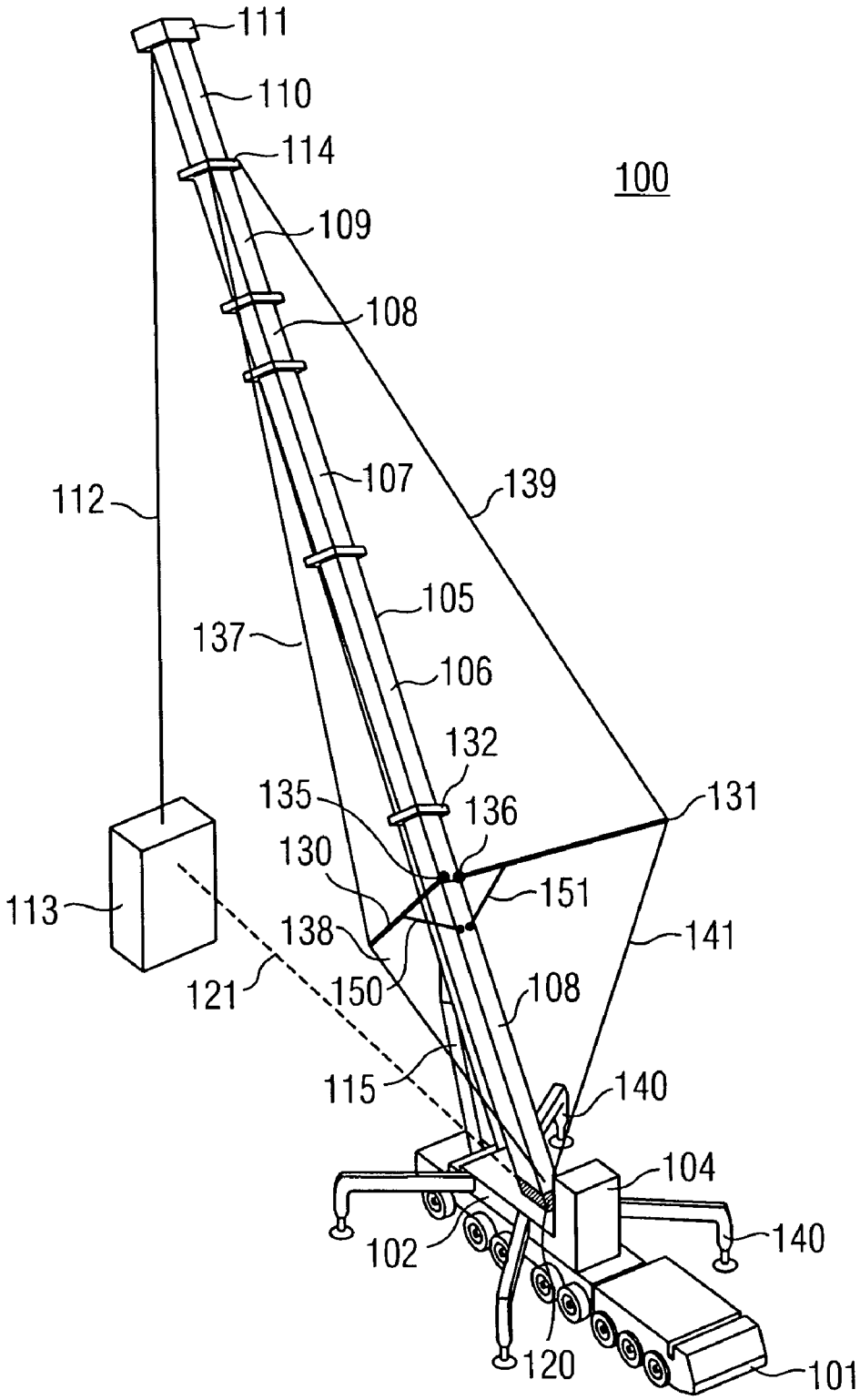
FIG. 8 shows a simplified representation of an exemplary embodiment of a telescopic crane according to the present invention comprising guy supports according to an exemplary embodiment of the present invention.

FIG. 8 shows a simplified representation of an exemplary embodiment of a telescopic crane according to the present invention comprising guy supports according to an exemplary embodiment of the present invention. Reference numeral 100 in FIG. 8 designates a telescopic crane, according to an exemplary embodiment of the present invention, including guy supports according to an exemplary embodiment of the present invention. The telescopic crane comprises a substructure 101, such as a driving platform including a motor, such that the telescopic crane 100 is self-driving. On the substructure 101, there is a superstructure 102, which is rotatably mounted onto the substructure 101. Furthermore, there is provided a boom base 103, which is arranged on the superstructure 102. The boom base 103 is part of a boom structure 105. Furthermore, there is provided a counterweight 104.

The boom structure 105 comprises the boom base 103 and a plurality of telescope sections 106, 107, 108, 109 and 110. The telescope section 106 is received in the boom base 103 and is respectively displaceable between a retracted and an extended position. The telescope section 107 is received in the telescope section 106 and is respectively displaceable between a retracted and an extended position. The telescope section 108 is received in the telescope section 107 and is respectively displaceable between a retracted and an extended position. The telescope section 109 is received in the telescope section 108 and is respectively displaceable between a retracted and an extended position. The telescope section 110 is received in the telescope section 109 and is respectively displaceable between a retracted and an extended position. In other words, the telescope section 110 is the innermost one of the telescope sections 106–110. The telescope section 110 is provided with a boom head 111 for guiding a rope 112 to which a load 113 can be attached. The telescope section 109 is provided with a collar 114.

Reference numeral 115 designates a hydraulic cylinder for lifting and lowering the boom structure 105 along the luffing plane. The luffing plane can be defined by three points, namely a first point at the base 120 of the boom structure 105, a second point at the boom head 111 and a third point, namely a center of gravity of the load 113. The triangle described by these three points is indicated with the dotted line 121 in FIG. 8. The triangle defined by these three points is shown between the boom base 105, the rope 112 and the dotted line 121 in FIG. 8.

The telescopic crane 100 is provided with two guy supports 130 and 131, which are mounted to the base boom 103 of the boom structure 105. As may be taken from FIG. 8, the guy supports 130 and 131 are mounted to an upper part of the boom base 103, close to a collar 132 of the boom base 103. However, it has to be noted that the guy supports 130 and 131 may also be provided at other suitable parts of the boom base 103 or of one of the telescope sections 106, 107, 108, 109 and 110. In spite of the provision of two guy supports 130 and 131, it is also possible to provide only one guy support. Also, instead of providing one pair of guy supports 130 and 131, a second pair or even further pairs of guy supports can be provided at the boom base 103 or at the telescope section 106, 107, 108, 109 and 110.

Each of the guy supports 130 and 131 is attached to the boom base 103 via a joint. The guy support 130 is attached to the boom base 103 via a joint 135 and the guy support 131 is attached to the boom base 103 via a joint 136. The joints 135 and 136 are constructed such that they allow a pivotal movement around the joints 135 and 136 boom structure 105, such that an inclination of each of the guy supports 130 and 131 by be independently varied with respect to the luffing plane. It has to be noted that the guy supports 130 and 131 may be connected by means of a cross-strut such that only a coordinated movement of both guy supports 130 and 131 is possible. This cross-strut may also be telescopic, i.e. allow for an extension and retraction. The joints or hinges 135 and 136 may directly be connected to the boom base 103 or may be mounted to a frame (not shown in FIG. 8), which is mounted to the boom base.

Preferably, the guy supports 130 and 131 including or excluding the joints 135 and 136 may be detachable from the boom base 103.

As shown in FIG. 8, each guy support 130 and 133 is connected to tension means. The guy support 130 is connected to a first tension means 137, extending between the collar 114 of the telescope section 109 to a distal end of the guy support 130 and a tensioning means 138, extending from the distal end of the guy support 130 to the substructure 101 of the telescopic crane. Preferably, the tension means 137 and 138 are one and the same rope.

Between the collar 114 of the telescope section 109 and the distal end of the guy support 131, there is provided a tension means 139. Between the distal end of the guy support 131 and a stabilizer foot 140 of a plurality of stabilizer feet 140 of the substructure, there is provided another tension means 141. Preferably, the tension means 139 and 141 may be realized with one and the same rope.

Instead of being attached to the substructure 101, the tension means 138 may also be attached to one of the boom base 103, the superstructure 102, the stabilizer foot 140 and the ground. Instead of being attached to the stabilizer foot 140, the tensioning means 141 may be attached to the boom base 103, to the superstructure 102, to the substructure 101 and to the ground.

Between the guy support 130 and the boom base 103, there is provided a stabilizer leg 150. Between the guy support 130 and the boom base 103 there is provided another support leg 151. Preferably, the support legs 150 and 151 are attached to the boom base 103 and to the respective one of the guy supports 130 and 131 via suitable joints. Also, the support legs 150 and 151 may be provided with telescope means, allowing a lengthening and shortening of a length of the support legs 150 and 151 to thereby accomplish that the guy supports 130 and 131 are folded to the boom base 103 for a transport.

Due to the joints 135 and 136, the guy supports 130 and 131 can be inclined with respect to the luffing plane. Such inclination can be adapted. Preferably, during operation of the telescopic crane, an inclination of the guy supports 130 and 131 can be selected such that a lateral load acting on the boom structure 105 is partially or entirely received by the guying, comprising the guy supports 130 and 131 and the tensioning means 137, 138, 139 and 141.

In a variant of the exemplary embodiment of the telescopic crane 100 and the guying device according to the exemplary embodiment shown in FIG. 8, the guy supports 130 and 131, including the joints 135 and 136 and the support legs 150 and 151 may form a separate constructional unit. To this, the guy supports 130 and 131, including joints 135 and 136 and the support legs 150 and 151 may be connected to each other by a frame. Then, instead of the joints 135, 136 and the support legs 150 and 151 being connected to the boom base 103, they are connected to the frame, which in turn is connected to the boom base 103. This allows a detachment of this guying for transport. Also, by this, even older cranes may be provided with this guying according to the present invention. This frame may, for example, be attached to the boom base 103 via bolts or by means of clamping. Also a welding connection is possible.

The guying shown in FIG. 8 allows for a very cost efficient modification of the telescopic crane. In particular due to the individual adjustment of the inclination of the guy supports 130 and 131 to the respective whipping position of the boom structure 150, an increase of the ultimate load which the telescopic crane may carry can be achieved. In particular this holds true for positions where the boom structure 105 has a steep inclination since, very often, the lateral deformation of the boom structure 105 is the load-limiting criteria. Due to the present invention, the lateral loads acting on the boom structure 105 may be directed to the substructure 101, to the superstructure 102 or to the ground.

Furthermore, the arrangement of the guy supports according to the present invention may fulfill a double function, namely in one position they serve for a normal super-lift operation and in another operating position they provide for a combination of super-lift operation and lateral guying. During the normal super-lift operation, the guy supports according to the present invention are arranged in the luffing plane or arranged parallel to the luffing plane. In the combination of super-lift operation and lateral guying, the guy supports are arranged with an inclination with respect to the luffing plane. This inclination may, for example, be 45°, such that forces acting laterally to the luffing plane and forces acting parallel to the luffing plane can be dealt with. Due to this, for example, when the boom structure is erected such that it is in a steep inclination, for example as shown in FIG. 8, the limit-load can be increased by almost 200% in comparison to a super-lift operation without an inclination of the guy supports 130 and 131 (i.e. guy supports parallel to the luffing plane).

The inclination of the guy supports 130 and 131 may be suitably adjusted between a position without an inclination where the guy supports 130 and 131 are in the plane of the luffing plane, i.e. parallel to the luffing plane and the other extreme position, where the guy supports are inclined with an angle of 90° to the luffing plane and where there is an angle of 180° between the two guy supports 130 and 131.

According to a variant of the exemplary embodiment shown in FIG. 8, also the inclination of the guy supports 130 and 131 in the luffing plane with respect to the boom base 103 is variable. The inclination of the guy supports 130 and 131 with respect to the luffing plane and the inclination of the guy supports 130 and 131 with respect to the boom structure 105 in the luffing plane may be adjusted continuously or step by step. It may be adjusted in a range of 0° to 90° or even 0° to 180°.

While the invention has been illustrated and described as embodied in a telescopic crane, it is not intended to be limited to the details shown since various modifications and structural changes may be made without departing in any way from the spirit of the present invention.

What is claimed is:

1. A telescopic crane, comprising:

a mobile substructure;

a superstructure rotatably mounted on the mobile substructure;

a telescopic boom structure pivotally mounted to the superstructure for angular motion along a luffing plane, wherein the telescopic boom structure includes a base section and at least one telescoping section, and wherein the telescoping section is received in the base section and is displaceable between retracted and extended positions;

at least one rigid guy support having a foot end and a top end, wherein the foot end of the at least one rigid guy support is pivotally attached to the telescopic boom structure;

a tension arrangement including a first tension sub-arrangement and a second tension sub-arrangement, wherein the top end of the at least one rigid guy support is connected via the first tension sub-arrangement to the base section, and wherein the top end of the at least one rigid guy support is further connected via the second tension sub-arrangement to a top end of the boom structure; and at least one adjusting device attached to the at least guy one support and the boom structure, the at least one adjusting device positions the at least one guy support in at least one inclined position with respect to the luffing plane of the telescopic boom structure.

2. The telescopic crane of claim 1, wherein the at least one adjusting device is a cylinder-piston unit.

3. The telescopic crane of claim 1, wherein the top end of the at least one rigid guy support is connected via the second tension sub-arrangement to one of the telescoping sections.

4. The telescopic crane of claim 1, further comprising:

at least one lifting unit for angularly raising and lowering the boom structure along the luffing plane.

5. The telescopic crane of claim 4, wherein the lifting unit is a hydraulic cylinder.

6. The telescopic crane of claim 1, wherein the at least one rigid guy support is operably fitted to selectively attach to and selectively detach from the boom structure.

7. The telescopic crane of claim 1, wherein the at least one rigid guy support further includes a girder at the foot end, the girder is attached to the boom structure and positioned transversely to the longitudinal direction of the boom structure.

8. The telescopic crane of claim 1, wherein the inclination of the at least one rigid guy support is one of (i) variable by steps and (ii) continuously variable.

9. The telescopic crane of claim 1, wherein the length of the at least one rigid guy support is variable.

10. The telescopic crane of claim 9, wherein the length of the at least one rigid guy support is one of (i) variable by steps and (ii) continuously variable.

11. The telescopic crane of claim 1, wherein the superstructure further includes a counterweight.

12. The telescopic crane of claim 1, wherein the tension arrangement includes at least one of a rope, a rod, a winch and a cylinder-piston unit.

13. The telescopic crane of claim 1, wherein the foot end of the at least one rigid guy support is pivotally attached to a top end of the boom structure.

14. The telescopic crane of claim 1, wherein the telescopic boom structure further includes at least one extension section, the extension section being attached to the innermost telescoping section at a top end of the boom structure, and wherein the at least one rigid guy support is connected via the second tension sub-arrangement to the extension sections.

15. The telescopic crane of claim 14, wherein the extension section includes a lattice tower.

16. The telescopic crane of claim 14, wherein the extension section is one of a fixed fly jib and a luffing fly jib including at least one slewed support.

17. The telescopic crane of claim 14, wherein the foot end of the at least one rigid guy support is pivotally attached to one of the telescopic sections.

18. The telescopic crane of claim 14, wherein the foot end of the at least one rigid guy support is pivotally attached to one of the extension sections.

19. The telescopic crane of claim 1, wherein the at least one rigid guy support includes two approximately parallel poles.

20. The telescopic crane of claim 19, wherein the at least one rigid guy support further includes a winch fitted between the two poles.

21. The telescopic crane of claim 19, wherein the at least one rigid guy support further includes a plurality of cross struts, and wherein a first pole of the two approximately parallel poles is connected to a second pole of the two approximately parallel poles using the plurality of cross struts.

22. The telescopic crane of claim 1, further comprising:

a measuring apparatus determining a lateral deformation of the boom structure, wherein the measuring apparatus is coupled with the at least one load adjusting device, and wherein the at least one load adjusting device modifies an incline angle of the at least one rigid guy support to apply a tautening force against the lateral deformation.

23. The telescopic crane of claim 22, wherein the lateral deformation is determined as a function of at least one of a crane parameter and an external force acting on the boom structure, the crane parameter including one of a rope tension, a rope length, and rope extension, and the external force including one of an amount of exposure to side winds, an amount of exposure to sunlight and a temperature of the boom structure.

24. A telescopic crane, comprising:

a mobile substructure;

a superstructure rotatably mounted on the mobile substructure;

a telescopic boom structure pivotally mounted to the superstructure for angular motion along a luffing plane, wherein the telescopic boom structure includes a base section and at least one telescoping section, and wherein the telescoping section is received in the base section and is displaceable between retracted and extended positions;

a rigid guy support having a foot end and a top end, wherein the foot end of the rigid guy support is pivotally attached to the telescopic boom structure;

a further rigid guy support having a foot end and a top end, wherein the foot end of the further rigid guy support is pivotally attached to the telescopic boom structure;

a tension arrangement including a first tension sub-arrangement and a second tension sub-arrangement, wherein the top end of the rigid guy support is connected via the first tension sub-arrangement to the base section, wherein the top end of the rigid guy support is further connected via the second tension sub-arrangement to a top end of the boom structure;

a further tension arrangement including a further first tension sub-arrangement and a further second tension sub-arrangement, wherein the top end of the further rigid guy support is connected via the further first tension sub-arrangement to the base section, wherein the top end of the further rigid guy support is further connected via the further second tension sub-arrangement to the top end of the boom structure; and an adjusting device attached to the rigid guy support and the boom structure, the adjusting device positioning the guy support in at least one inclined position with respect to the luffing plane of the telescopic boom structure;

a further adjusting device attached to the further guy support and the boom structure, the further adjusting device positioning the further guy support in at least one inclined position with respect to the luffing plane of the telescopic boom structure, wherein the rigid guy support is inclinable to a first side of the luffing plane, and wherein the further rigid guy support is inclinable to a second side of the luffing plane.

25. The telescopic crane of claim 24, wherein the inclination of the guy support is separately variable from the inclination of the further rigid guy support.

26. The telescopic crane of claim 24, wherein the boom structure includes a first surface intersecting the luffing plane and a second surface situated on a first side of the luffing plane, and a third surface situated on a second side of the luffing plane, wherein the rigid guy support is pivotally attached to a first transition area of the boom structure situated between the first surface and the second surface, and wherein the further rigid guy support is pivotally attached to a second transition area of the boom structure situated between the first surface and the third surface.

27. A guying device for a boom structure of a crane, comprising:

at least one rigid guy support having a foot end and a top end, wherein the foot end of the at least one rigid guy support is pivotally attachable to the boom structure and the top end of the at least one rigid guy support is adapted to be coupled with a tension arrangement connected to a top end of the boom structure and a bottom end of the boom structure; and at least one adjusting device attached to the at least one guy support and the boom structure, the at least one adjusting device positions the at least one guy support in at least one inclined position with respect to a luffing plane of the boom structure, wherein the foot end of the at least one rigid guy support is operably fitted to selectively attach to and selectively detach from the boom structure.

28. The guying device of claim 27, wherein at least one adjusting device is a cylinder-piston unit.

29. The guying device of claim 27, wherein at least one rigid guy support further includes a girder at the foot end, the girder is adapted to be attached to the boom structure and positioned transversely to the longitudinal direction of the boom structure.

30. The guying device of claim 27, wherein the inclination of the at least one rigid guy support is one of (i) variable by steps and (ii) continuously variable.

31. The guying device of claim 27, wherein a length of the at least one rigid guy support is variable.

32. The guying device of claim 31, wherein the length of the at least one rigid guy support is one of (i) variable by steps and (ii) continuously variable.

33. The guying device of claim 27, wherein the at least one rigid guy support includes two approximately parallel poles.

34. The guying device of claim 33, wherein the at least one rigid guy support further includes a winch fitted between the two poles.

35. The guying device of claim 27, wherein the at least one rigid guy support includes a plurality of cross struts, and wherein the first pole of the two approximately parallel poles is connected to a second pole of the two approximately parallel poles using the plurality of cross struts.

36. The guying device of claim 27, further comprising:

a measuring apparatus determining a lateral deformation of the boom structure, wherein the measuring apparatus is coupled with the at least one adjusting device, and wherein the at least one adjusting device modifies an inclined angle of the at least one rigid guy support to apply a tautening force against the lateral deformation.

37. The guying device of claim 36, wherein the lateral deformation is determined as a function of at least one of a crane parameter and an external force acting on the boom structure, the crane parameter including one of a rope tension, a rope length, and rope extension, and the external force including one of an amount of exposure to side winds, an amount of exposure to sunlight and a temperature of the boom structure.

38. A guying device for a boom structure of a crane, comprising:

a first rigid guy support having a foot end and a top end, wherein the foot end of the first rigid guy support is pivotally attachable to the boom structure and inclinable to a first side of a luffing plane of the boom structure, and wherein the top end of the first rigid guy support is couplable with a tension arrangement connected to a top end of the boom structure and a bottom end of the boom structure;

a second rigid guy support having a foot end and a top end, wherein the foot end of the second rigid guy support is pivotally attachable to the boom structure and inclinable to a second side of the luffing plane, and wherein the top end of the second rigid guy support is couplable with a tension arrangement connected to a top end of the boom structure and a bottom end of the boom structure;

a first adjusting device attached to the first guy support and attachable to the boom structure, the first adjusting device positioning the first guy support in at least one inclined position with respect to the first side of the luffing plane; and a second adjusting device attached to the second guy support and the boom structure, the second adjusting device positioning the second guy support in at least one inclined position with respect to a second side of the luffing plane.

39. The guying device of claim 38, wherein the foot end of the first rigid guy support is operably fitted to selectively attach to and selectively detach from the boom structure, and wherein the foot end of the second rigid guy support is operably fitted to selectively attach to and selectively detach from the boom structure.

40. The guying device of claim 38, wherein the inclination of the first guy support is separately variable from the inclination of the second rigid guy support.

41. The guying device of claim 38, wherein the boom structure includes a first surface intersecting the luffing plane and a second surface situated on a first side of the luffing plane, and a third surface situated on a second side of the luffing plane, wherein the first rigid guy support is pivotally attached to a first transition area of the boom structure situated between the first surface and the second surface, and wherein the second rigid guy support is pivotally attached to a second transition area of the boom structure situated between the first surface and the third surface.

42. The guying device of claim 38, further comprising:

a frame including a mounting arrangement operably fitted to selectively attach the frame to and selectively detach the frame from the boom structure, wherein the first rigid guy support, the second rigid guy support, the first adjusting device, and the second adjusting device are attached to the same.

43. A method for guying a boom structure of a telescopic boom crane, comprising:

adjusting a length of at least one adjusting device attached to at least one rigid guy support and the boom structure, the at least one adjusting device positions the at least one guy support in at least one inclined position with respect to a luffing plane of the telescopic boom crane.

44. The method of claim 43, further comprising:

measuring deformation parameters, the deformation parameters including at least one of a crane parameter and an external force acting on the boom structure;

determining a lateral deformation of the boom structure as a function of the deformation parameters; and modifying an incline angle of the at least one rigid guy support to apply a tautening force against the lateral deformation, the at least one rigid guy support is coupled with a tension arrangement connected to a top end of the boom structure and a bottom end of the boom structure.

45. The method of claim 43, wherein the crane parameter includes one of a rope tension, a rope length and a rope extension, and wherein the external force includes one of a strength and a direction of a laterally occurring wind, an amount of solar radiation and a temperature of the boom structure.

46. The method of claim 43, further comprising:

changing a length of the at least one rigid guy support to apply a tautening force against the lateral deformation.

47. The method of claim 44, wherein the adjusting step includes (i) varying the length of the at least one adjusting device by steps and (ii) continuously varying the length of the at least one adjusting device.

48. The method of claim 43, wherein the modifying step includes (i) varying the incline angle of the at least one rigid guy support by steps and (ii) continuously varying the incline angle of the at least one rigid guy support.

49. The method of claim 44, wherein the changing step includes (i) varying the length of the at least one rigid guy support by steps and (ii) continuously varying the length of the at least one rigid guy support.

* * * * *